US008408137B2

(12) United States Patent
Battaglia

(10) Patent No.: US 8,408,137 B2
(45) Date of Patent: Apr. 2, 2013

(54) SPIRAL CASE AMMUNITION

(76) Inventor: Vin Battaglia, Easton, CT (US)

( * ) Notice: Subject to any disclaimer, the term of this patent is extended or adjusted under 35 U.S.C. 154(b) by 273 days.

(21) Appl. No.: 12/775,088

(22) Filed: May 6, 2010

(65) Prior Publication Data

US 2010/0282112 A1 Nov. 11, 2010

Related U.S. Application Data

(60) Provisional application No. 61/175,923, filed on May 6, 2009, provisional application No. 61/230,855, filed on Aug. 3, 2009.

(51) Int. Cl.
*F42B 5/30* (2006.01)
*F42B 5/26* (2006.01)
*F42B 5/307* (2006.01)

(52) U.S. Cl. ..... 102/464; 102/466; 102/467; 102/470; 102/430

(58) Field of Classification Search ..... 102/465, 102/466, 467, 469, 464, 430, 439, 468, 470, 102/471, 472
See application file for complete search history.

(56) References Cited

U.S. PATENT DOCUMENTS

| | | | | |
|---|---|---|---|---|
| 1,940,657 | A | 1/1933 | Woodford | |
| 3,076,409 | A * | 2/1963 | Williams et al. | 102/465 |
| 3,098,444 | A * | 7/1963 | Walkey et al. | 102/464 |
| 3,339,487 | A | 9/1967 | Stadler et al. | |
| 3,566,792 | A * | 3/1971 | Grandy | 102/430 |
| 3,598,052 | A * | 8/1971 | Schwartz et al. | 102/431 |
| 3,706,256 | A * | 12/1972 | Grandy | 86/1.1 |
| 5,048,421 | A * | 9/1991 | Swartout | 102/431 |
| 6,860,207 | B1 * | 3/2005 | Robertson | 102/450 |
| 7,213,519 | B2 | 5/2007 | Wiley et al. | |
| 2007/0261587 | A1 | 11/2007 | Chung | |

FOREIGN PATENT DOCUMENTS

GB 885369 12/1961

OTHER PUBLICATIONS

International Search Report for PCT/US2010/033882 dated Jul. 19, 2010.

* cited by examiner

*Primary Examiner* — James Bergin

(57) ABSTRACT

A cartridge for a firearm comprises a case having a base located at one end and a projectile mounted at the other end. A specific volume of propellant is contained in the case and is ignitable via a primer located in the base. The ignition of the propellant causes the projectile to be propelled from the case. The case comprises a wall defining a plurality of circumferential flutes that extend around outer and inner surfaces of the case in a helical or vertical configuration.

34 Claims, 14 Drawing Sheets

SPIRAL CASE AMMUNITION

CROSS REFERENCE TO RELATED APPLICATIONS

This application claims the benefits of U.S. Provisional Patent Application No. 61/175,923, filed on May 6, 2009, and U.S. Provisional Patent Application No. 61/230,855, filed on Aug. 3, 2009, the contents of both applications being incorporated herein by reference in their entireties.

TECHNICAL FIELD

The present invention relates generally to ammunition and, more particularly, to ammunition cartridges in which an outer surface of the cartridge is defined by flutes along at least a portion of the cartridge.

BACKGROUND

Standard ammunition cartridges for firearms are typically unitary in construction with the structural components of the cartridge being made from metal. In general, the cartridge includes a case of a generally cylindrical shape and terminated at a rearward end by a base having a rim. A propellant is contained in the case, and a primer is located in the base. A bullet or projectile is frictionally held in a forward end of the case. The case is sized to a particular caliber, which closely approximates the diameter of the projectile and is less than the diameter of the bore defined by the barrel of the firearm through which the projectile moves. When the cartridge is in battery located at a rearward end of the bore, operating the firearm causes the primer to be ignited (e.g., via a firing pin), which in turn ignites the propellant (usually gunpowder). Gases resulting from the ignition of the gunpowder result in an increase in pressure within the case, thereby causing the case to expand. Upon continued expansion of the case, the outer surface of the case seals against the wall of the firing chamber. Because the case cannot expand any further, there is a buildup of pressure in the case that causes ejecta to leave the case at its determined pressure so the projectile can achieve the correct velocity. The spent case is either removed manually or by the weapons operating system.

In commercial practice most ammunition is manufactured with drawn brass cases that are generally cylindrical and define a smooth outer circumferential surface that approximates the shape of the walls of the firing chamber. During firing of the cartridge, peak pressure is imparted to the case. The elasticity of the brass allows the case to expand diametrically under pressure and to contact the walls of the firing chamber forming a suitable seal in the firing chamber. In doing so, the engineered hoop strength of the material will not yield but will retain its original geometry through material memory. Once the pressure is relieved, the case returns to its original (or near original) condition. This quality, which is known as the "springback" of the case, facilitates the extraction of the case from the firing chamber. Without the case material exhibiting sufficient springback, the case would not return to its engineered taper, thereby resulting in increased friction at extraction and possibly malfunction.

SUMMARY

In one aspect, the present invention resides in a cartridge for a firearm. The cartridge comprises a case having a base located at one end and a projectile mounted at the other end. A specific volume of propellant is contained in the case and is ignitable via a primer located in the base. The ignition of the propellant causes the projectile to be propelled from the case. The case comprises a wall defining a plurality of circumferential flutes that extend around outer and inner surfaces of the case in a helical or vertical configuration.

In another aspect, the present invention resides in a cartridge for a firearm. The cartridge comprises a case having a wall arranged to define a substantially cylindrical member having a forward end, a rearward end, and inner and outer surfaces, a projectile located at the forward end of the case, and a base located at the rearward end of the case. A specific volume of propellant is located in the case and is in communication with and configured to be ignited by a primer located in the base through a flash hole. Each of the inner surface and the outer surface of the case defines a plurality of flutes that extend helically or vertically along the substantially cylindrical member.

In another aspect, the present invention resides in an assembly for an ammunition cartridge. This assembly comprises a substantially cylindrical case and a base located at a rearward end of the case. The case, which is fabricated from a partial polymeric material, comprises a wall configured to define a plurality of flutes extending longitudinally between the rearward end of the case and a forward end of the case with the plurality of flutes being defined on inner and outer surfaces of the wall. The base comprises a metallic insert that houses the primer and further creates a metallic rim for ejection from the weapon, its upper portion creates a new feature or flash base and also the traditional flash hole. The base also includes a body, the body being formed from the partial polymeric material and over-molded on at least a portion of the housing. The body further defines an outer surface having a plurality of flutes that matingly engage the flutes defined by the inner surface of the case in a close fit to allow for bonding adhesive to be inserted at time of assembly.

DETAILED DESCRIPTION

Figure 1:
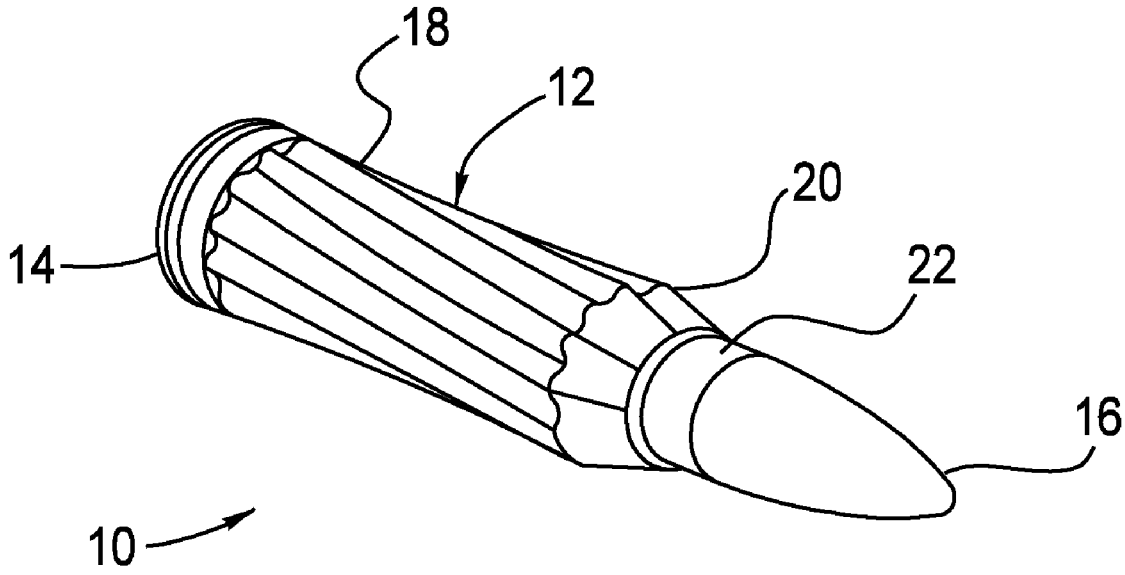
FIG. 1 is a perspective view of a cartridge, of the present invention.

Referring to FIGS. 1-4, a cartridge for use in a firearm is shown generally at 10 and comprises a case body defined by a case 12, a propellant contained in the case, a base 14 that is inserted into the case body, and a projectile 16 mounted in the case. The primary use for the cartridge 10 of the present invention is with regard to small arms ammunition such as 5.56 mm (NATO) ammunition and larger through 50 BMG (Browning Machine Gun) ammunition. The present invention is not limited in this regard, however, as other sizes of ammunition can employ the configurations disclosed herein, particularly with regard to pistol, rifle, and grenade case (30 mm and 40 mm) ammunition. In any embodiment, however, the case 12 is substantially cylindrical in shape and defined by a wall 18. The wall 18 defines an interior area of the case 12 that contains the propellant. The base 14 is located on a rearward end of the case body and includes a primer for igniting the propellant when the cartridge 10 is fired. A forward end of the case body includes a shoulder portion 20 that tapers into a neck portion 22. The projectile 16 is mounted in the neck portion 22.

The case 12 and at least portions of the base 14 may be fabricated from one or more polymeric materials. The polymeric material may be a composite defined by a polymer or polymeric matrix that contains one or more of glass fiber, carbon fiber, carbon nanotubes, and combinations of the foregoing materials. Another polymeric material found to be suitable as a material for the case 12 is polyetheretherketone (PEEK) functionalized with 2-5 wt.% of carbon nanotubes. Additives may be incorporated into the polymeric material, such additives including, but not limited to, wetting agents, molding agents, release agents, colorants, combinations of the foregoing, and the like. The present invention is not limited to the polymeric material being a composite or PEEK, however, as other materials such as polyetherketone (PEK), polyphenylsulfone, combinations of the foregoing materials, and the like may be used.

Figure 5:
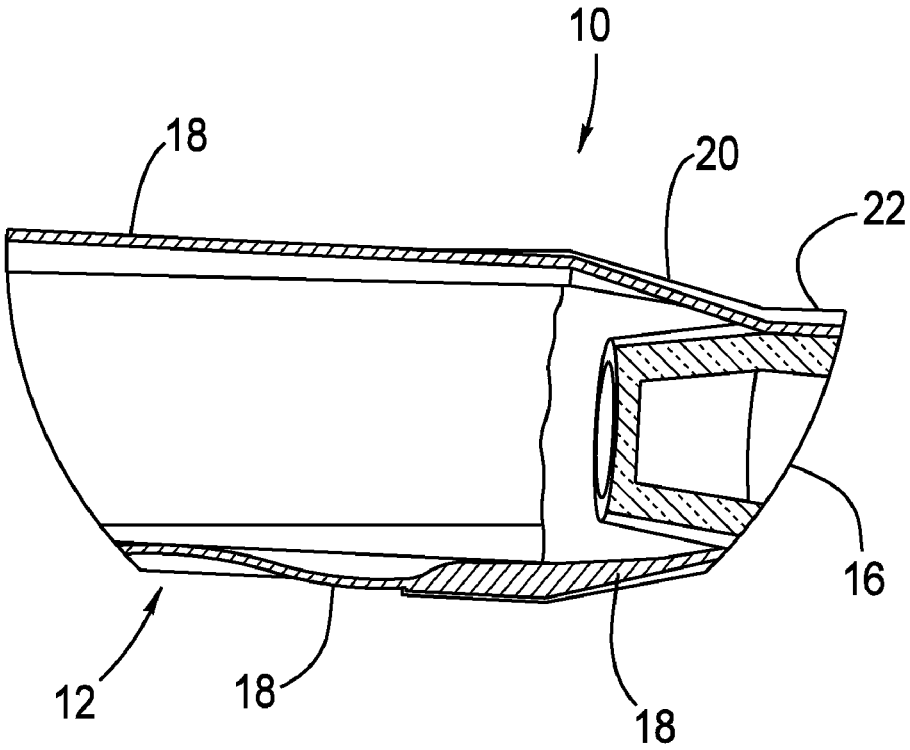
FIG. 5 is a side sectional view of an area in a neck of a case of the cartridge of FIG. 1.
Figure 6:
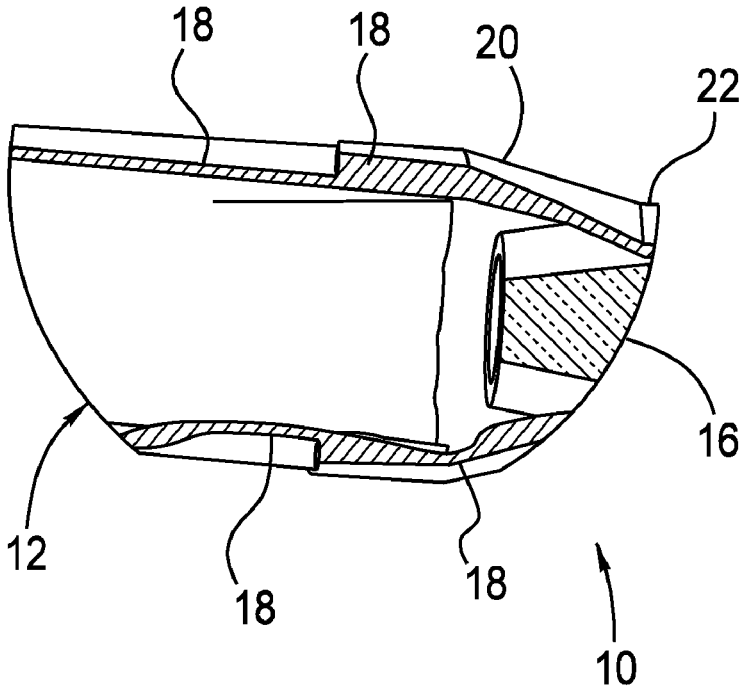
FIG. 6 is another side sectional view of the area in the neck of the case of the cartridge of FIG. 1.

Referring now to FIGS. 5 and 6, the wall 18 of the case 12 is thicker in the area of the shoulder portion 20 and the neck portion 22 than it is rearward of the shoulder portion, thereby reinforcing the neck portion to ensure that the projectile 16 can be suitably mounted in the case 12 in a mechanical interference fit and retained in the cartridge 10. The thicker portion of the wall 18 also ensures that, upon firing, pressure in the cartridge is contained until the pressure reaches a desired level whereupon the projectile 16 is caused to separate from the case 12.

Figure 7:
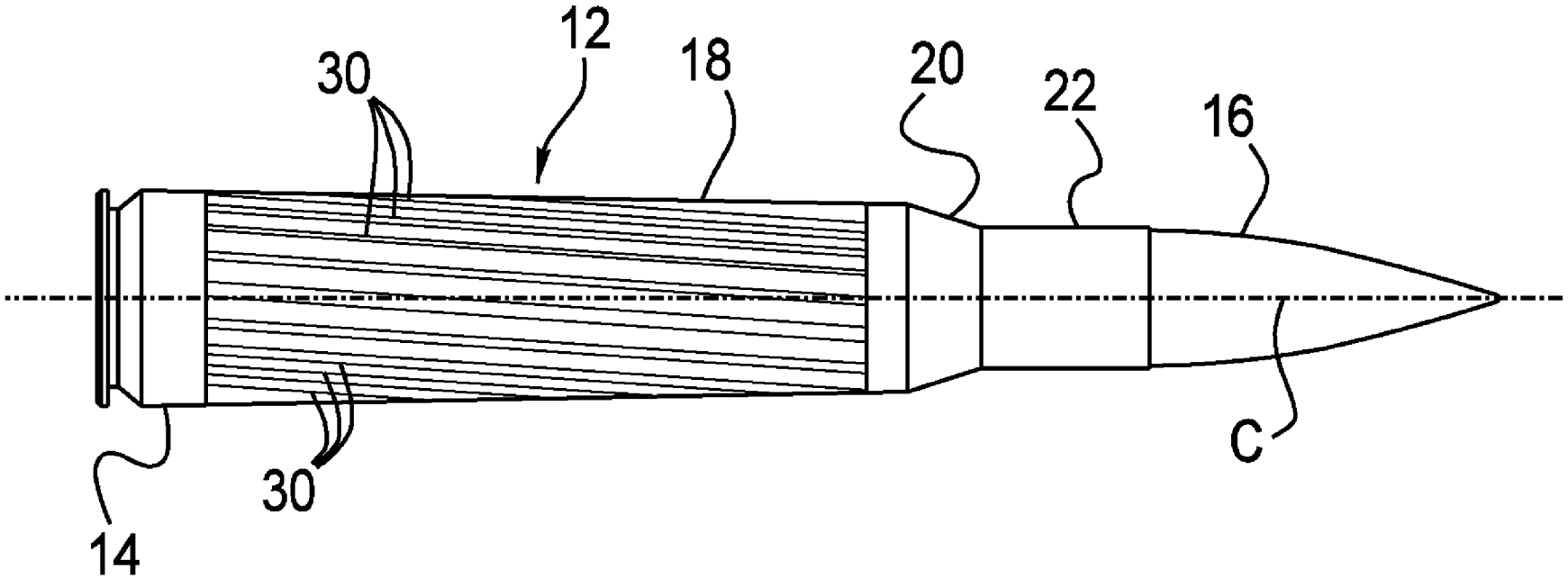
FIG. 7 is a side view of a cartridge of the present invention.

As can be seen in FIG. 7, the wall 18 defines a plurality of flutes 30 on the outer surface of the case 12 having a centerline C. The flutes 30 extend along the length of the outer surface of the case from the rearward end to the forward end and terminate proximate the shoulder portion 20. In the illustrated embodiment, the flutes 30 are helically arranged around the case 12 at an angle of about 2 degrees to about 20 degrees. However, the present invention is not limited in this regard as the flutes can also be straight or be configured in other patterns without departing from the broader aspects of the invention.

The helical arrangement of the flutes 30 on the outer surface of the case 12 forms a corresponding helical arrangement of the flutes 30 on the inside of the case 12. On the inside of the case 12, however, the flutes 30 extend through the shoulder portion 20 and to the neck portion 22. The helical arrangement of the flutes 30 on the inside of the case 12 allows the base 14 to be matingly attached to the case body in a mechanical interference fit after which the base is glued or comelted to the case body. The case body is a separate component that is molded, extruded, machined, or otherwise formed and to which the base 14 and the projectile 16 can be attached.

Figure 2:
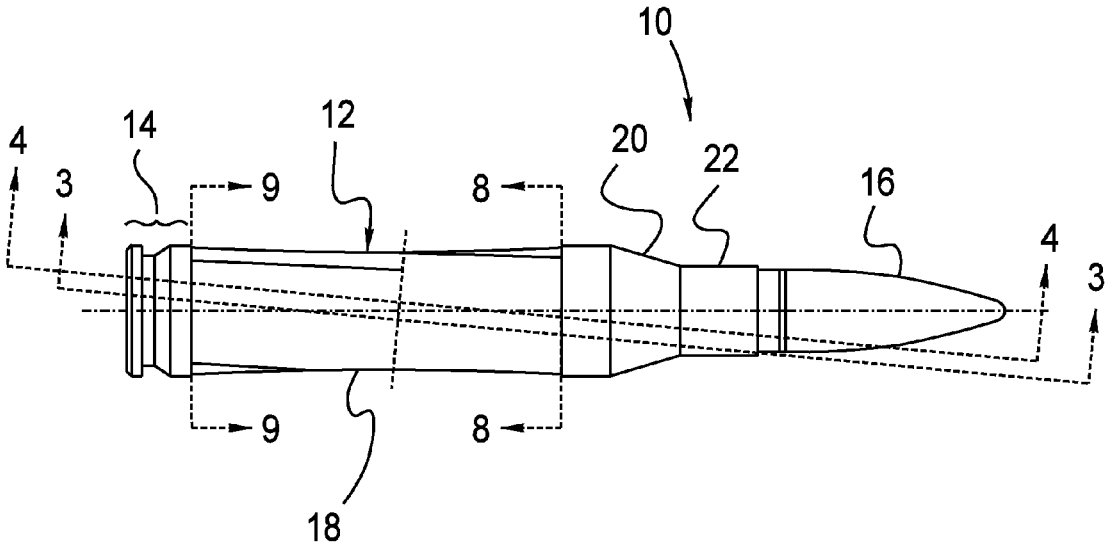
FIG. 2 is a side view of the cartridge of FIG. 1.
Figure 3:
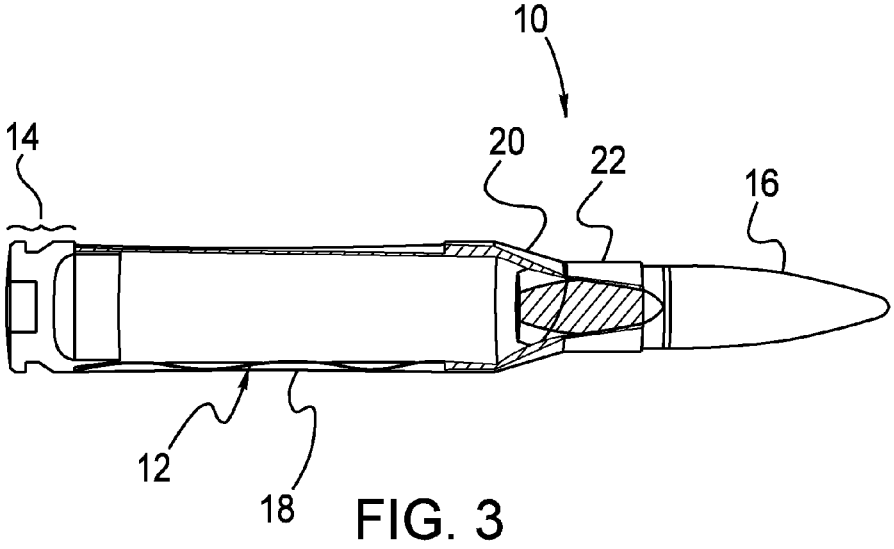
FIG. 3 is a side sectional view of the cartridge of FIG. 1.
Figure 4:
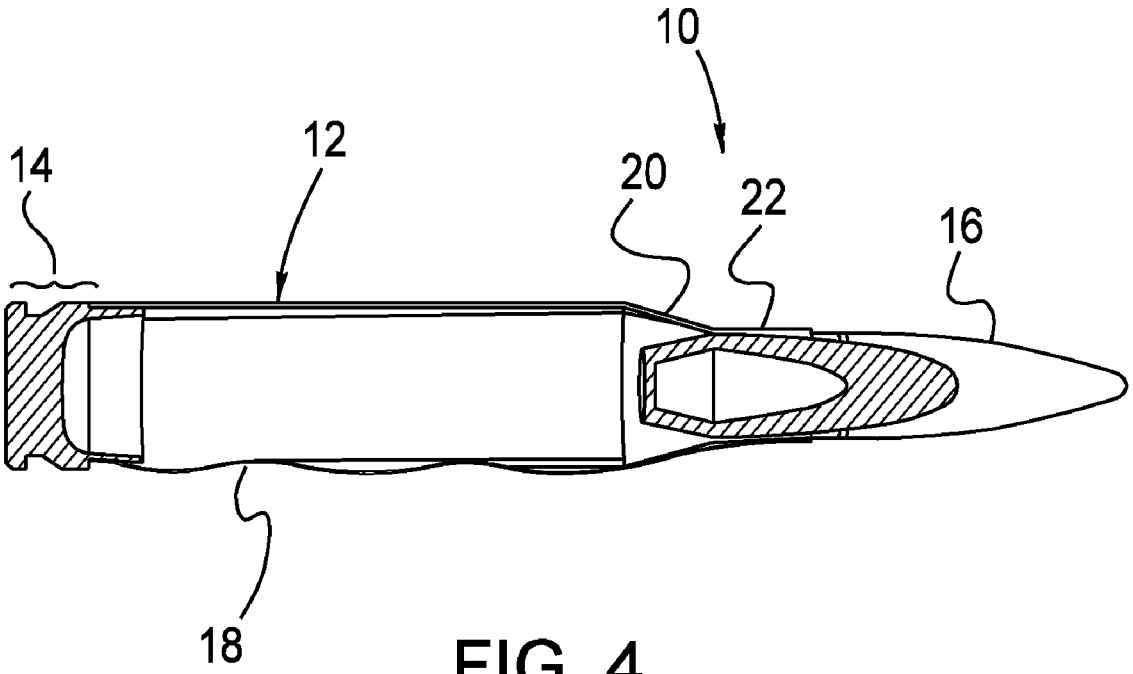
FIG. 4 is another side sectional view of the cartridge of FIG. 1.
Figure 8:
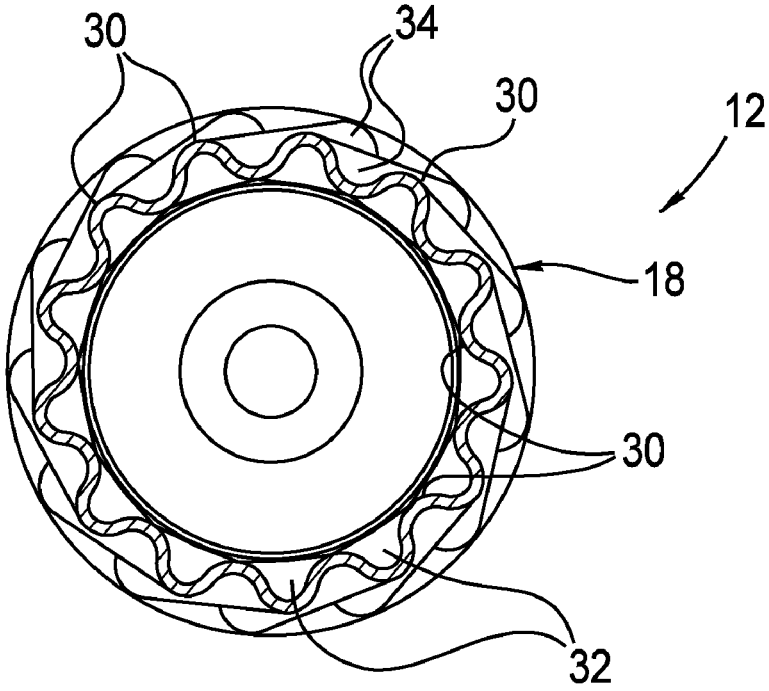
FIG. 8 is a top sectional view from a forward end of the case.
Figure 9:
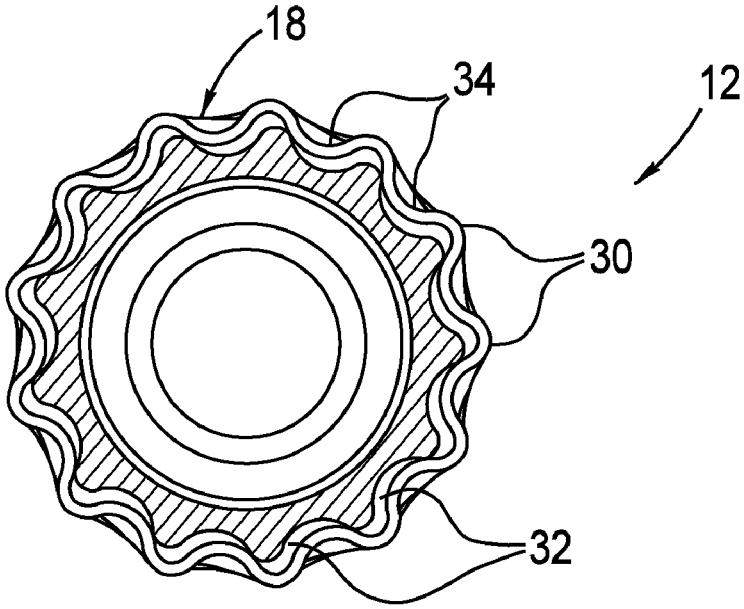
FIG. 9 is a bottom sectional view from a rearward end of the case.

Referring now to FIGS. 2, 8, and 9, the wall 18 of the case 12 defines a plurality of flutes 30 on an inner surface 32 of the wall (FIG. 8). Flutes 30 are also defined by an outer surface 34 of the wall 18 (FIG. 9). The distance between a peak of a flute 30 on the outer surface 34 and a peak of a flute on the inner surface 32, as well as the distance from either peak to an adjacent peak, is calculated to provide a helical arrangement of the flutes 30 having a desired configuration, thereby imparting predetermined mechanical properties to the case 12. The helical arrangement of the flutes 30 is selected to improve the strength of the case 12 (relative to cases of the related art) in a cross-sectional direction (the "hoop strength") and also enhances the compressive loading (force exerted on the case along the centerline C), thereby allowing the case to flex to accommodate the insertion of the projectile 16 into the neck portion 22. The helically-arranged flutes 30 can be configured to either minimize the potential for cartridges to interlock from one case to the next or to enhance the belt feeding of cartridges by creating latching surfaces on the outer surfaces 34 of the cases 12. Furthermore, the flutes 30 provide for a reduction in the surface area of the case 12 (relative to straight wall cases of the related art) that contacts the walls of the firing chamber, thereby reducing the amount of heat transferred from the walls of the firing chamber to the case and inhibiting the softening or melting of the polymer. Reducing the amount of heat transferred from the walls of the firing chamber to the case 12 may also reduce the potential for cook off. Additionally, by manufacturing the case 12 from the polymer (at least in part) instead of brass or other metal, the weight of the case is reduced, thereby also reducing the weight of the cartridge. For example, in a 50 BMG cartridge, the overall weight of the case is reduced by about 47% and the overall weight of the cartridge is reduced by about 15% (as compared to a similar cartridge incorporating brass instead of polymer).

In addition to improving the hoop strength, reducing the heat transfer abilities, and reducing the weight of the cartridge, the helical arrangement of the flutes 30 reduces the amount of friction in the extraction of the spent case 12 from the firing chamber. In particular, the flutes 30 reduce the amount of contact the case 12 has with the walls of the firing chamber such that when the spent case is engaged by an extraction device and pulled in a rearward direction for ejection from the firearm, the amount of heat generated from the friction due to extracting the spent case is minimal (reduced by about 70%). Furthermore, the portion of the case 12 in the area of the base 14 along the edge at which the flutes 30 terminate is strengthened by the flutes 30, thereby resisting substantial deflection of the wall of the case 12 during the process of extracting the case from the firing chamber and ejecting the case from the firearm.

Also, the flutes 30 can be helically arranged at the desired angle accordance with the rotational movements of the cartridge 10 in the firearm. For example, when the firearm is a rifle having a 1:4 twist, the helical arrangement of the flutes 30 on the case 12 of the cartridge 10 for the rifle can have a corresponding degree of spiral around the case such that the twist defined by the flutes on the case matches the twist in the bore of the rifle. In doing so, the ballistic qualities of the cartridge 10 can be improved over the cartridges of the related art, particularly cartridges having cases defined by non-fluted walls.

Figure 10:
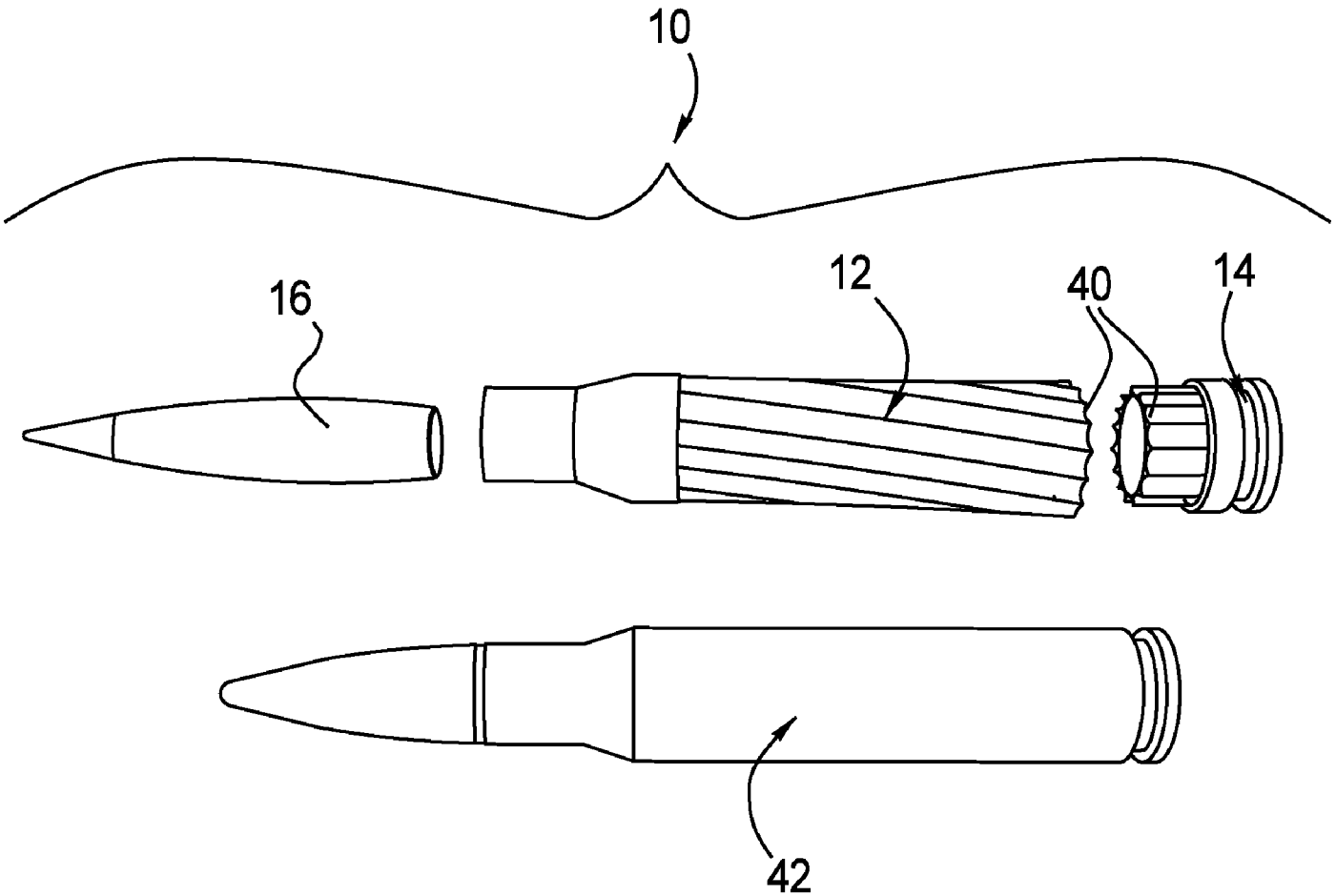
FIG. 10 is an exploded view of the cartridge, of the present invention, compared to a prior art cartridge.

Referring now to FIG. 10, at least a portion of the base 14 is also substantially cylindrical in shape and includes a wall that is fluted on the outside. The flutes 40 are helical and positioned similarly to the flutes 30 defined by the inside surface 32 of the wall 18, thereby allowing the base to mate with the case. As can be seen, the cartridge 10 is similar in size and shape (except for the flutes 30 on the case 12) to a typical cartridge 42, which in this case is a 50 BMG cartridge.

Figure 11:
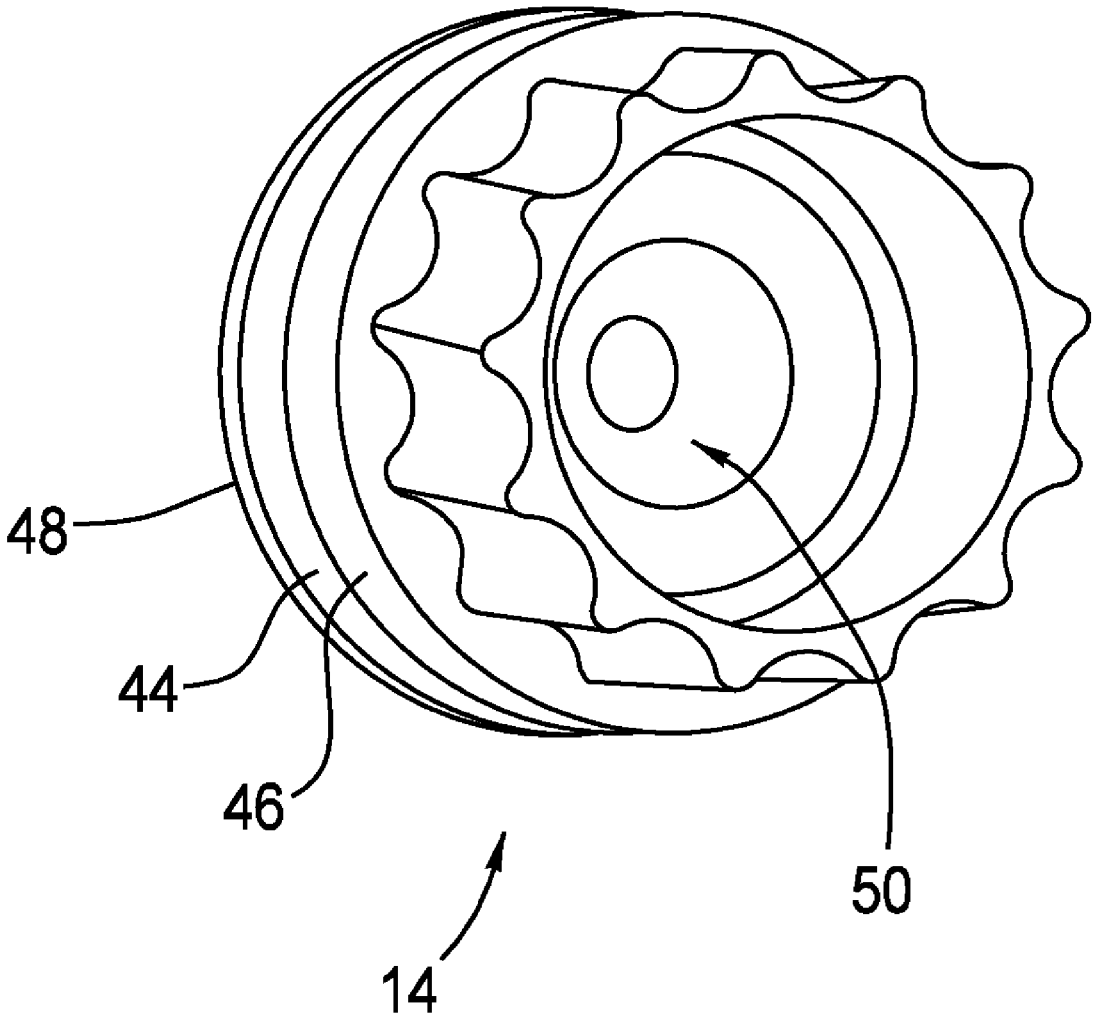
FIG. 11 is a perspective view of a base of the cartridge of FIG. 1.

Referring now to FIG. 11, the base 14 includes a rim 44 at a rearward end of the substantially cylindrical portion. The rim 44 includes a relief or channel 46 extending circumferentially therearound to allow a suitable mechanism to engage a rearward surface 48 defining the channel 46 (in the process of extracting a spent cartridge 10 after firing and ejecting the cartridge). A hole 50 extends through a bottom surface 52 of the base 14 to provide communication between a primer located in the bottom surface and the propellant carried by the cartridge 10.

The base 14 (and the rim 44) can be manufactured by any suitable operation. In one operation, the base 14 can be manufactured in a stamping process (particularly if the base is made at least in part of a metal such as aluminum).

Figure 12:
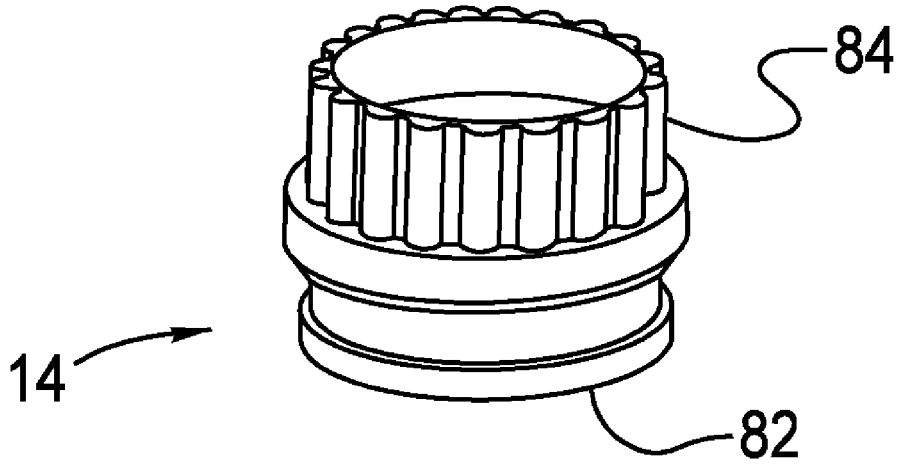
FIG. 12 is a perspective view of a base of the cartridge in which a body is over-molded onto a housing.
Figure 13:
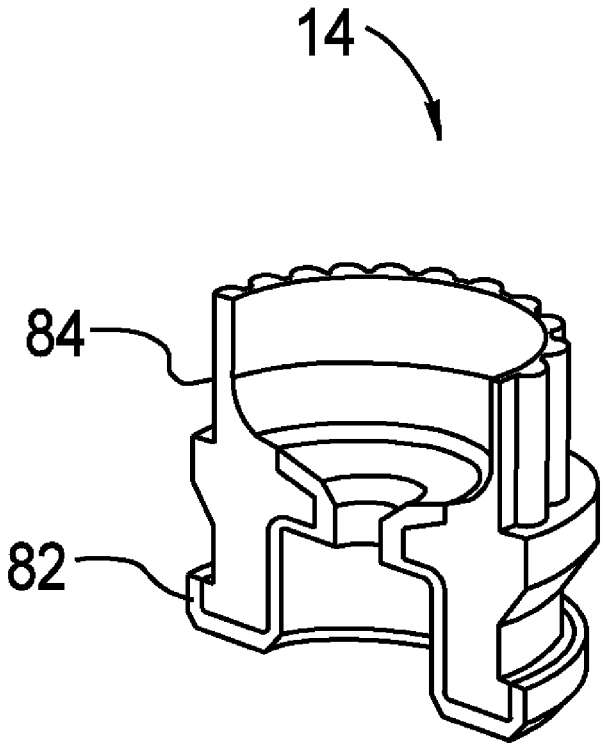
FIG. 13 is a cutaway perspective view of the base of FIG. 12.
Figure 14:
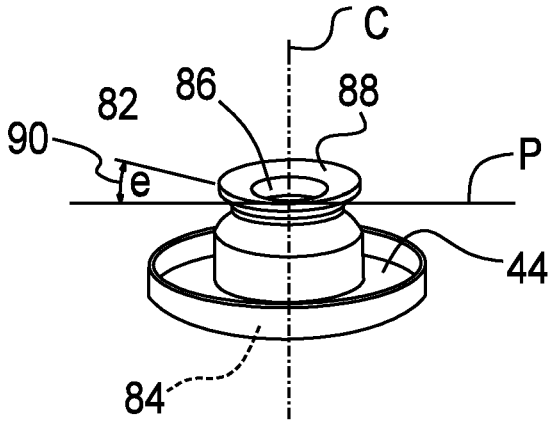
FIG. 14 is a perspective view of the housing of the base of FIG. 12.

In another operation, the base 14 as shown in FIGS. 12-14 can be manufactured using an insert molding process. The base 14 manufactured using the insert molding process comprises a stamped housing 82 over which a body 84 is molded. The over-molded material of the body 84 is preferably the same material as is used for the case body. Utilizing the same materials for the body 84 and the base allows the case body to be received in the base and joined thereto in a comelt or glued bond. One or more acetyl or cyanic-based adhesives can be employed to join the case body 84 of the base 14 to the case.

Referring to FIG. 14, the housing 82 is preferably steel, although other materials may be used. Using steel (or at least another metal or alloy) allows for efficient extraction of cases by enabling an ejector to engage an upturned edge of the rim 44 (in the process of extracting a spent cartridge from the firing chamber after firing), thereby allowing for extraction and avoiding subjecting the polymeric material of the case 12 directly to the forces of the extraction which may compromise the integrity of the case. The housing 82, as shown in FIG. 14, includes the rim 44 and a rearward surface 84 that defines a rearward end of the substantially cylindrical portion of the case into which the base 14 is inserted. The hole 50 extends through the base 14 from the rearward surface 84 to a forward surface 88. A primer can be located in the hole 50 in any suitable manner (e.g., by being press fit or by using staked insertion).

The forward surface 88 of the base defines a cone or flash pan with the inside concave portion thereof facing forward. An angle 90 defined by the forward surface 88 relative to a plane P perpendicular to the centerline C extending longitudinally through the case 12 is about 10 degrees. The present invention is not limited in this regard, as the angle 90 may be more or less than 10 degrees. By configuring the concave portion of the forward surface 88 to have an angle of about 10 degrees, however, faster ignition of propellant, as compared to the forward surface being flat, can be realized. More specifically, upon ignition of the primer in the hole 50, the propellant proximate the rearward end of the case 12 is ignited first, and the ignition is propagated through the propellant to the forward end of the case. By angling the forward surface 88, the ignition can be directed to the forward end of the case, thereby limiting the amount of early ignition of the propellant in the lateral directions (e.g., perpendicular to the centerline C). Furthermore, the helical arrangement of the flutes 30 may further contribute to the propagation of the ignition from the rearward end to the forward end by directing the ignition along the walls of the case 12 in the flutes 30.

Figure 15:
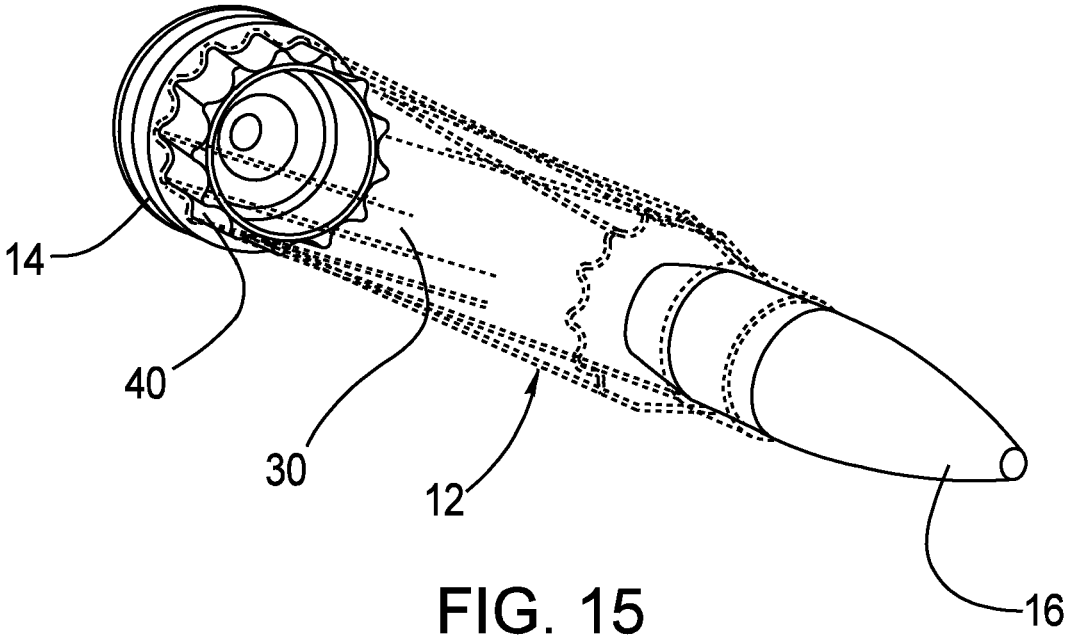
FIG. 15 is a perspective view of the cartridge, of the present invention, shown in phantom.

As shown in FIG. 15, upon insertion of the base 14 into the rearward end of the case body, the flutes 40 are received in the flutes 30 defined on the inside surface 32 of the wall 18 of the case 12 in the interference fit and joined in a comelt or glued bond. One benefit of incorporating an insertable base 14 having flutes 40 that are received in the case 12 in a mechanical interference fit and joined in a comelt or glued bond is that the amount of surface area usable for engaging and bonding the base to the case is increased. The increase in engaging and bonding surface area provided by the flutes 30 on the case 12 provides a bond that is significantly greater than the bond effected in similar case/base assemblies having smooth engaging walls. More specifically, with regard to cartridges 10 for small arms as described herein, the increase in the usable surface area for engaging and bonding the base to the case is about 55% (as compared to non-fluted cartridges 10).

In joining the base 14 to the case 12 as described herein, another benefit is realized in that the mechanical interference joint (with the comelt or glued bond) does not experience the full pressure of the ignition of the propellant. Due to the twist of the helical arrangement of the flutes 30 of the case 12 engaged with the flutes 40 of the base 14, about 30% of the force in the rearward direction from the ignition of the propellant is mitigated due to the mechanical joint created by the helical relationship. In doing so, only about 70% of the pressure is experienced by the base 14 in a direction parallel to the centerline C. Thus, the helical arrangement of the flutes contributes to the mechanical joining of the base 14 to the case 12.

Figure 16:
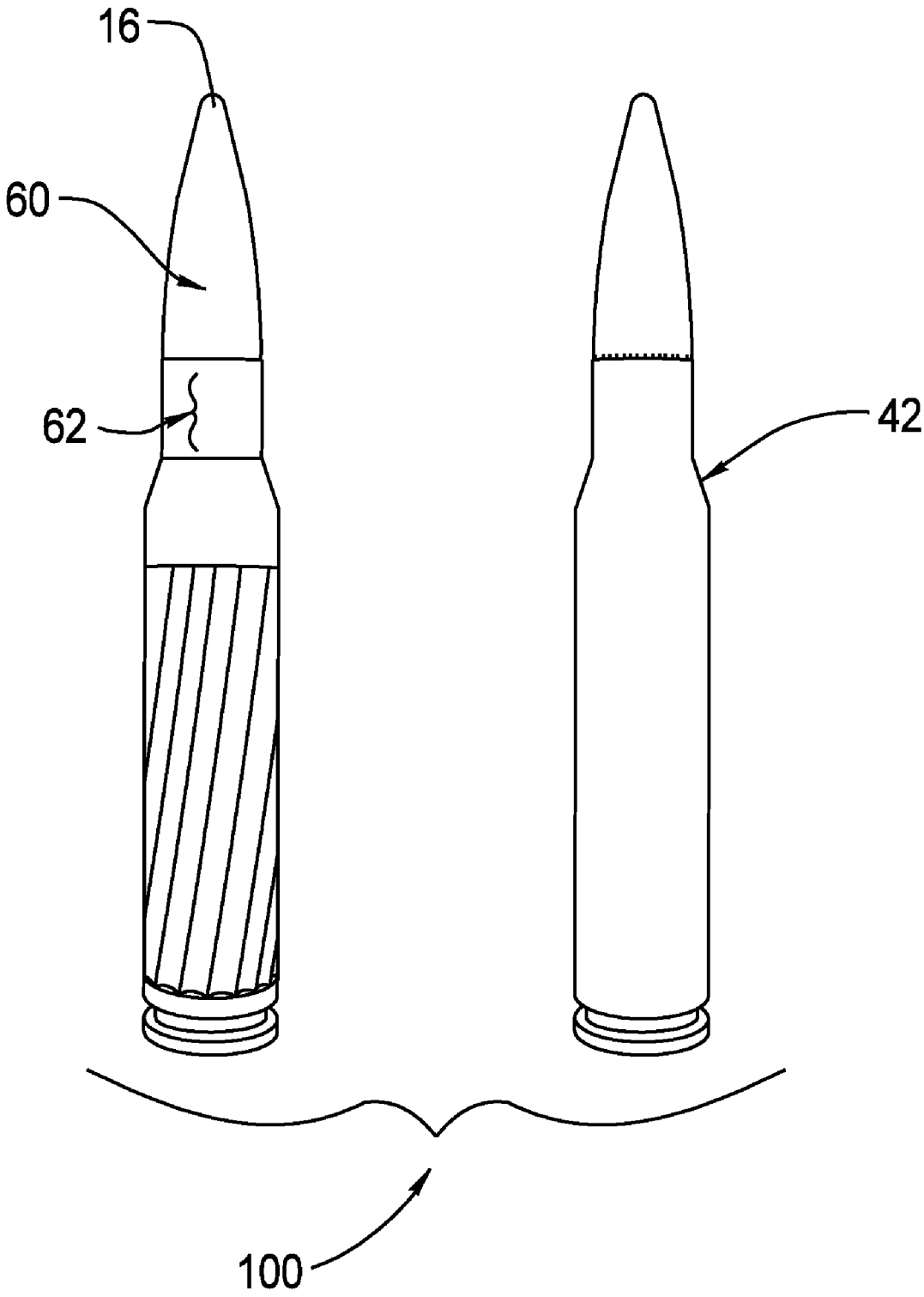
FIG. 16 is a side view of a physical model of the cartridge, of the present invention, compared to a prior art cartridge.

Referring now to FIG. 16, the cartridge 10 can be designed using rapid prototyping (RPT) techniques. These RPT techniques take virtual designs from computer aided design or animation modeling software, transform the designs into virtual cross-sections, and then create each cross-section in physical space using an RPT material, assembling the cross-sections to define a physical model 60 that corresponds to the virtual designs. As can be seen in a comparison 100, the physical model 60 that is used in the development of the cartridge 10 is a close approximation of a typical 50 BMG cartridge 42. The desired elevation (height of the cartridge 10 from the base to the forward-most end of the projectile 16) is determined by the overlap of a bond area 62 (the area at which the neck of the case 12 and the projectile overlap in an assembled cartridge). The present invention is not limited to 50 BMG cartridges, however, as any other cartridge caliber is within the scope of this disclosure.

In the present invention, the characteristics of the RPT material (e.g., density) used to fabricate the physical model 60 closely approximate the characteristics of the polymer used to fabricate the case 12 of the cartridge 10. This allows for actual measurement data to be obtained in instances where data cannot be calculated. For example, using the physical model 60, actual data can be measured for charge weights and volumes (amount of propellant), actual weight savings per round, measurement of surface areas at which the case engages the wall of the firing chamber, and measurement of surface areas at which various portions of the cartridge 10 are bonded or otherwise attached to each other. Also, visualization of prospective or actual processes of manufacture (such as molding) can be carried out using the physical model 60.

The embodiments of the cartridge 10 described herein and its methods of manufacture can be used with traditional ammunition manufacturing equipment (such as a SCAMP line). In particular, a molded (or otherwise formed) case and base can be built as subcomponents and assembled. In one method of assembly, a base 14 can be attached to a case 12, propellant charged to the case, and a projectile 16 fitted to the case. In another method of assembly, the projectile 16 can be attached to the case 12, the case charged with propellant, and the base 14 attached to the case. The adaptability of toggling between such methods provides the cartridge 10 of the present invention with several advantages.

One advantage of subcomponent manufacturing is that at least some of the subcomponents manufactured are inert. Different subcomponents can be provided by different manufacturers, at different facilities, or by the same manufacturer at different facilities or locations. Thus, the level of security afforded to the manufacture of ammunition can be varied depending on the particular subcomponent. Furthermore, just-in-time (JIT) techniques can be used in the assembly of the subcomponents, which means that a multitude of manufacturers can be employed, thereby eliminating the need for stand-alone munitions plants.

Another advantage is that costs associated with demilling live ammunition can be mitigated. Because polymers are used in the present invention, and further because the cartridges of the present invention can be manufactured as subcomponents and assembled, the various subcomponents can be destroyed or recycled on an as-needed basis. Because of this subcomponent manufacturing and the capability for JIT assembly, it has been discovered that demilling costs on the order of about 50% can be saved by making fewer finished cartridges (live ammunition) and stockpiling fewer subcomponents.

Example 1

Propellant Charge Weight Evaluation

The physical model 60 (FIG. 16) was manufactured with the projectile at the desired location in the case from animation modeling software in accordance with government specifications. The cartridge 10 was then developed based on the physical model 60. Using the animation modeling software to manufacture the physical model 60 and developing the cartridge 10 from the physical model enabled accurate propellant charge weight measurements to be obtained. A 50 BMG cartridge made of brass was determined to weigh 0.284 pounds (lbs.), and a cartridge 10 of the present invention was determined to weigh 0.193 lbs. The weight reduction was 0.091 lbs.

Figure 17:
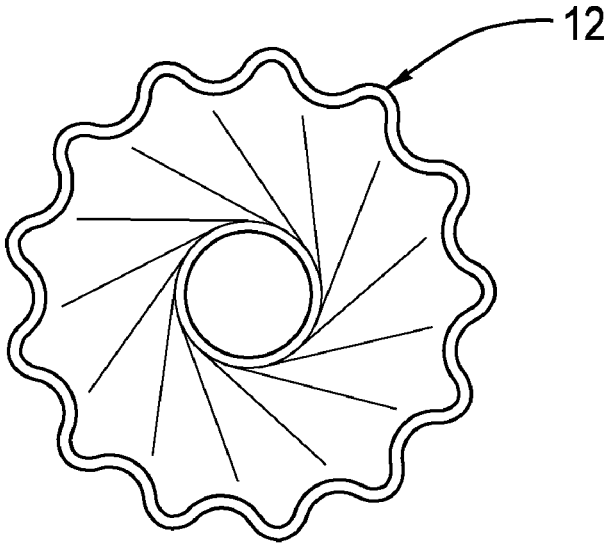
FIG. 17 is a top view of the case of the cartridge of FIG. 1.
Figure 18:
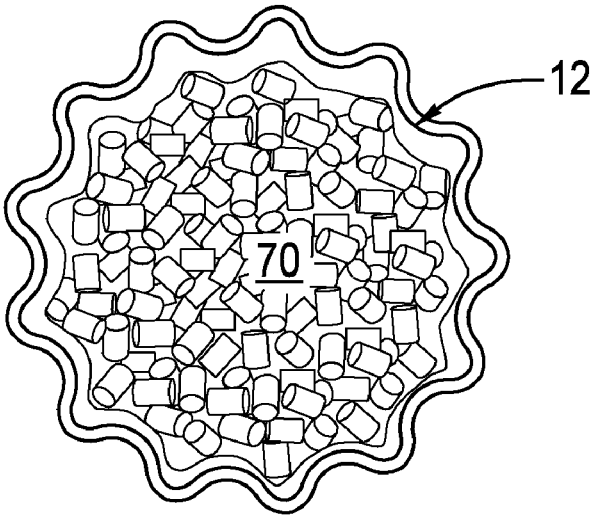
FIG. 18 is a top view of the case of FIG. 17 in which the case is filled with propellant.

In the cartridge 10, referring now to FIGS. 17 and 18, the case 12 (empty in FIG. 17) was then filled to the desired level with propellant 70 (FIG. 18) and weighed to determine the amount of propellant charged.

In some embodiments, a charge bag (e.g., a pouch or envelope) was inserted into the case 12 before filling with propellant 70. The charge bag shaped the propellant charge to correspond with the case 12 in the area of the base 14. In some embodiments, the charge bag left multiple air channels in the voids of the propellant charge, these air channels providing for accelerated ignition of the cartridge 10 upon firing and thereby yielding a higher projectile velocity. The charge bag could be conical in shape to allow the base 14 to have the needed egress for assembly, thereby allowing additional grains of propellant to be housed in the base of the cartridge 10 above the primer.

Figure 19:
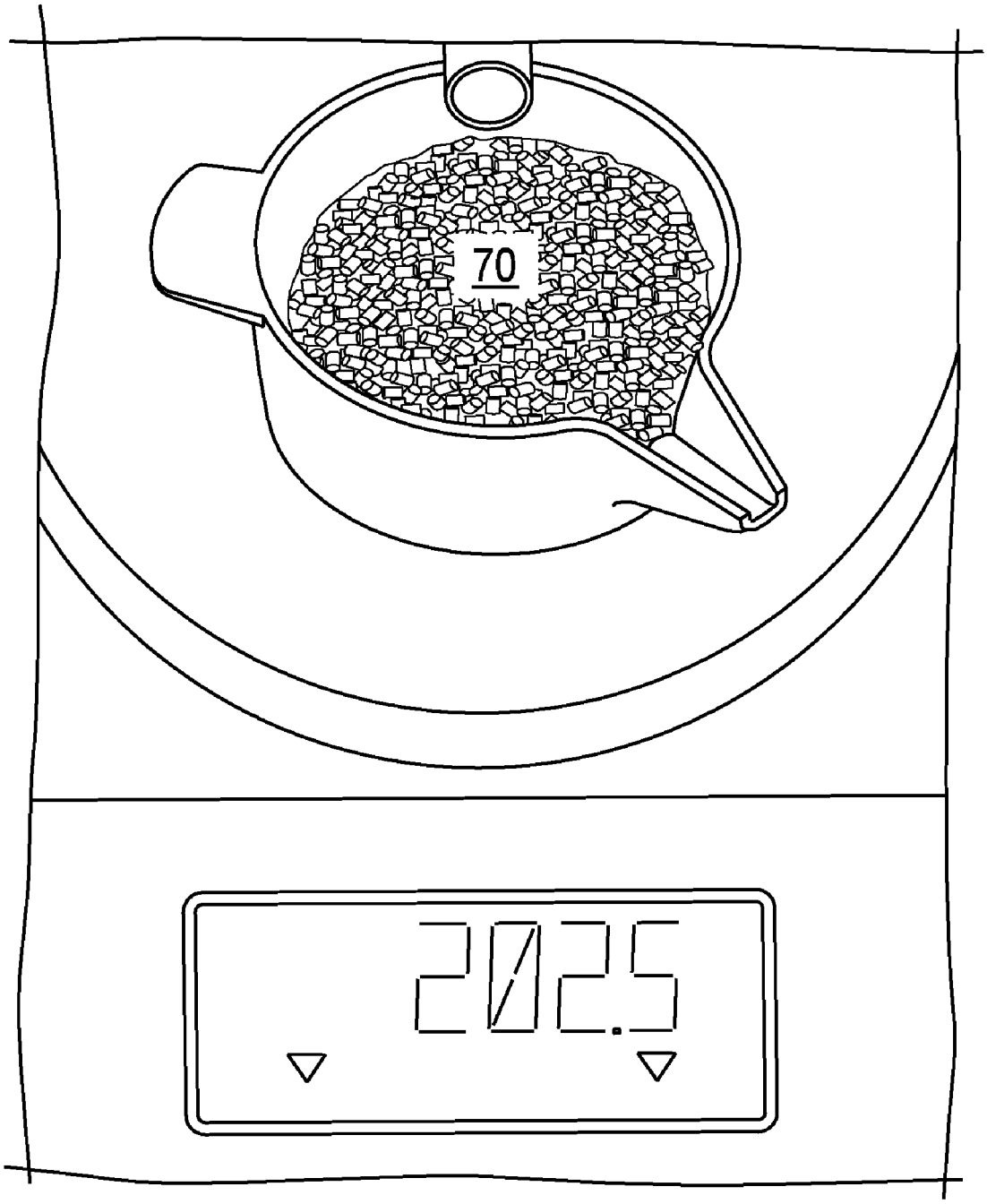
FIG. 19 is a perspective view of a determined amount of propellant being weighed for use in a cartridge, of the present invention.

Referring now to FIG. 19, the propellant 70 charged to the case 12 was in accordance with government specifications.

Example 2

Cartridge Weight Evaluation

Figure 20:
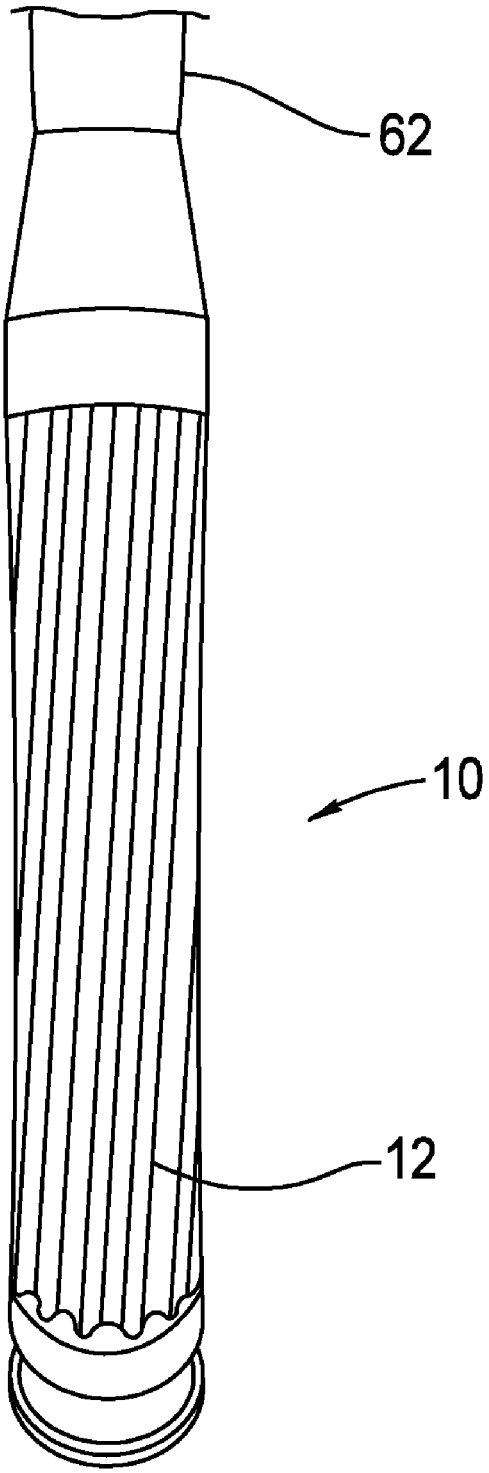
FIG. 20 is a side view of the case of the cartridge, of the present invention.

Referring now to FIG. 20, the physical model 60 (FIG. 16) enabled an accurate weight measurement of a manufactured cartridge 10 to be taken, which allowed further computations to be made. The cartridge 10 produced from the physical model 60 was sufficiently translucent to enable the propellant 70 located in the case 12 to be observed. Furthermore, the translucency enabled the bond area 62 to be discerned.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A cartridge for a firearm, the cartridge comprising:
- a case having a first end and a second end;
- a base located at the first end of the case;
- a projectile mounted in the second end of the case;
- a propellant contained in the case; and
- a primer located in the base, the primer being configured to ignite the propellant;
- the case comprising a wall defining a plurality of flutes extending from the first end and terminating proximate the second end, the flutes being of a helical configuration, and the flutes extending around an outer surface and an inner surface of the case.

2. The cartridge of claim 1, wherein the second end of the case defines a shoulder portion that tapers into a neck portion, the projectile being mounted in the neck portion, and wherein a thickness of a wall defining the neck portion is greater than a thickness of the wall defining the case.

3. The cartridge of claim 2, wherein the flutes extend from the first end and terminate in the shoulder portion.

4. The cartridge of claim 1, wherein the base is substantially cylindrical in shape and is defined by a wall having a plurality of flutes arranged in a helical configuration on an outer surface thereof, the flutes on the outer surface of the base being configured to engage with the flutes on the inner surface of the first end of the case in an interference fit.

5. The cartridge of claim 1, wherein the base comprises,
- a rim located at a rearward end thereof, the rim defining a channel extending circumferentially around the rim, and
- a surface defining a hole extending through a bottom surface of the base, the primer being located in the hole and being in communication with the propellant.

6. The cartridge of claim 1, wherein the base comprises a housing and a body located on the housing, the housing comprising a rearward surface and a surface defining a hole extending from the rearward surface through the housing, the primer being located in the hole.

7. The cartridge of claim 1, wherein the base comprises a stamped housing having a plurality of flutes on an outer surface thereof, the flutes being configured to matingly engage the plurality of flutes on the inner surface of the case.

8. The cartridge of claim 7, wherein the plurality of flutes defining the wall of the case and the plurality of flutes on the outer surface of the base are arranged at an angle of about 2 degrees to about 20 degrees relative to an axis defined longitudinally through the case.

9. The cartridge of claim 1, wherein the base includes a forward surface that defines a flash pan having a concave surface that faces the propellant.

10. The cartridge of claim 9, wherein an angle defined by the forward surface of the flash pan is about 10 degrees.

11. The cartridge of claim 1, wherein a material from which the case is fabricated is a polymeric material.

12. The cartridge of claim 11, wherein a polymer of the polymeric material is selected from the group of polymers consisting of polyetheretherketone, polyetherketone, polyphenylsulfone, and combinations of the foregoing.

13. The cartridge of claim 1, wherein a material from which the case is fabricated is one or more of polyetheretherketone and polyetherketone functionalized with carbon nanotubes.

14. The cartridge of claim 13, wherein the carbon nanotubes are present at about 2 wt. % to about 5 wt. %.

15. The cartridge of claim 1, wherein the base and the case are fabricated from a polymeric material and joined in a comelt bond.

16. The cartridge of claim 1, wherein the base and the case are joined using a glue.

17. A cartridge for a firearm, the cartridge comprising:

a case comprising a wall arranged to define a substantially cylindrical member having a forward end, a rearward end, and an inner surface and an outer surface, each of the inner surface and the outer surface defining a plurality of flutes that extend helically along the inner surface and the outer surface;

a projectile located in the forward end of the case;

a base located in the rearward end of the case; and a propellant located in the case and in communication with and configured to be ignited by a primer in the base.

18. The cartridge of claim 17, wherein the forward end of the cylindrical member includes a shoulder portion and a neck portion located on the shoulder portion, the projectile being retained in the neck portion.

19. The cartridge of claim 17, wherein the base comprises a substantially cylindrical body having an outer surface defining a plurality of flutes that extend helically along the substantially cylindrical body, the plurality of flutes on the outer surface of the base being configured to be received in the plurality of flutes on the inner surface of the cylindrical member of the case in a mechanical interference fit and being joined using a glue.

20. The cartridge of claim 19, wherein the substantially cylindrical body comprises a housing therein, the housing comprising a surface defining a hole extending from a forward portion of the housing to a rearward portion of the housing, the primer being located in the hole.

21. The cartridge of claim 20, wherein the forward portion of the housing includes a flash pan defined by an angled surface configured to direct a flash from an ignition of the primer to the propellant to increase velocity of the projectile in a convergent manner.

22. The cartridge of claim 17, wherein a material from which the case body and the base are fabricated comprises a polymer.

23. The cartridge of claim 22, wherein the polymer is selected from the group consisting of polyetheretherketone, polyetherketone, polyphenylsulfone, and combinations of the foregoing materials.

24. The cartridge of claim 17, wherein the plurality of flutes extend helically along the substantially cylindrical member at an angle of about 2 degrees to about 20 degrees.

25. An assembly for an ammunition cartridge, the assembly comprising:

a substantially cylindrical case comprising a wall configured to define a plurality of flutes extending helically between a rearward end of the case to a forward end of the case, the case comprising a polymeric material, the plurality of flutes being defined on an inner surface of the wall and an outer surface of the wall; and a base located at the rearward end of the case, the base comprising a housing and a body over-molded on at least a portion thereof, the body comprising the polymeric material, an outer surface of the body defining a plurality of flutes matingly joined to the flutes on the inner surface of the wall of the case in a mechanical interference fit.

26. The assembly of claim 25, wherein the polymeric material comprises one or more of polyetheretherketone and polyetherketone functionalized with carbon nanotubes.

27. The assembly of claim 26, wherein the polymeric material comprises about 2 wt. % to about 5 wt. % carbon nanotubes.

28. The assembly of claim 25, wherein the base comprises a surface defining a hole extending between a forward end and a rearward end of the base through the housing, the hole being configured to receive a primer therein.

29. The assembly of claim 25, wherein a forward end of the housing defines a flash pan defining a forward surface having an angle of about five degrees to about twenty degrees.

30. The assembly of claim 25, wherein the plurality of flutes defined by the outer surface of the base body are matingly joined to the flutes on the inner surface of the wall of the case body using a comelt bond.

31. The assembly of claim 25, wherein the plurality of flutes defined by the outer surface of the body are matingly joined to the flutes on the inner surface of the wall of the case using a glue.

32. The assembly of claim 25, wherein the plurality of flutes defining the wall of the case and the plurality of flutes of the body of the base are arranged at for the caliber from a parallel axis of the vertical centerline of the case to about 20 degrees relative to an axis defined longitudinally through the case.

33. The assembly of claim 25, wherein the housing of the base defines a metallic rim having a channel extending circumferentially therearound, the channel being configured to receive a mechanism for the extraction of the assembly from a firearm.

34. The assembly of claim 25, wherein the flutes defined by the wall of the substantially cylindrical case are configured to provide a selected hoop strength and a selected compressive loading to the case to optimize the wall thickness and greatest potential internal volume for propellant charge weight.

* * * * *